US005720189A

United States Patent [19]

Youn

[11] Patent Number: 5,720,189

[45] Date of Patent: Feb. 24, 1998

[54] PULSATOR ASSEMBLY FOR A WASHING MACHINE

[75] Inventor: Kab Jin Youn, Kwangju, Rep. of Korea

[73] Assignee: Daewoo Electronics Co., Ltd., Seoul, Rep. of Korea

[21] Appl. No.: 642,940

[22] Filed: May 6, 1996

[30] Foreign Application Priority Data

Jul. 27, 1995 [KR] Rep. of Korea ..... 95-22381

[51] Int. Cl.[6] ..... D06F 37/40

[52] U.S. Cl. ..... 68/133; 68/134

[58] Field of Search ..... 68/133, 134

[56] References Cited

U.S. PATENT DOCUMENTS 1,506,783 9/1924 Snyder ..... 68/133

2,554,573 5/1951 Johnson ..... 68/133 X

FOREIGN PATENT DOCUMENTS 10759 3/1985 Japan ..... 68/133

99292 6/1985 Japan ..... 68/133

*Primary Examiner*—Philip R. Coe

*Attorney, Agent, or Firm*—Beveridge, DeGrandi, Weilacher & Young LLP

[57] ABSTRACT

Disclosed is a pulsator assembly for a washing machine. The pulsator assembly comprises a pulsator rocking in right, left, up and down directions while rotating forwards or in reverse according to a forward or revere rotation force and a connecting member engaging the pulsator with a shaft while freely moving the pulsator. The free rocking movements of the pulsator prevent the pulsator from being damaged due to a overload of laundry articles and create a vortex water current to increase a cleaning efficiency as well as to decrease the tangling of the laundry articles.

10 Claims, 4 Drawing Sheets

PULSATOR ASSEMBLY FOR A WASHING MACHINE

BACKGROUND OF THE INVENTION

1. Field of the Invention

The present invention relates to a washing machine, and more particularly to a pulsator assembly for a washing machine.

2. Description of the Prior Art

Generally, a washing machine washes a laundry article according to predetermined washing cycles. That is, general washing cycles are composed of a water supply step, a washing step, a rinsing step, a draining step and a dehydrating step. During the water supply step, water is supplied to a water reservoir of the washing machine, the washing step is introduced to wash the laundry article, the washed laundry article is rinsed at the rinsing step, the used water is drained from the water reservoir at the draining step, and finally at the dehydrating step water soaked in the laundry article is removed therefrom. As shown in FIG. 1, the conventional washing machine has a water reservoir 5, which is mounted within a retangular box-shaped main body, for containing water. Within water reservoir 5, a washing tub 4 in which laundry articles are put is provided. A pulsator 6 is rotatably installed at the inner bottom of washing tub 4. Pulsator 6 agitates the water in washing tub 4. The middle of pulsator 6 is fixed at one end of a shaft 2 by a bolt 3. Shaft 2 passes through the center of washing tub 4 and water reservoir 5. At the other end of shaft 2 a shaft pulley 7 is fixed. Shaft 2 is rotatably mounted by a shaft housing 8 disposed at the center of the outer bottom of water reservoir 5 as shown in FIG. 1A. At the outer bottom of water reservoir 5, a driving motor 1 is provided. At the shaft of driving motor 1, a driving pulley 9 is connected. Driving pulley 9 and shaft pulley 7 are connected to each other by means of a pulley belt 15. Accordingly, forward or reverse driving power generated when driving motor 1 rotates in a forward or reverse direction is transmitted to shaft 2 through pulley belt 15 and rotates shaft 2 forwards or in reverse. Such rotations of shaft 2 cause pulsator 6 to be rotated. By the rotation of pulsator 6 the laundry article contained in washing tub 4 is cleaned.

However, in the conventional pulsator assembly as mentioned above, when a laundry article in washing tub 4 is being washed, pulsator 6 experiences heavy load caused by the laundry article since pulsator 6 is fixed to one end of shaft 2. Thus, if pulsator 6 operates with a heavy load for a long time period, pulsator 6 likely accumulates fatigue to decrease a strength of pulsator 6, thereby causing pulsator 6 to be finally damaged. Also, in such conventional pulsator assembly as mentioned above, since pulsator 6 is disposed in parallel with the bottom of washing tub 4, it is difficult to increase the washing power by vortex water current as well as to prevent laundry articles from being twisted and tangled.

SUMMARY OF THE INVENTION

It is the object of the present invention to provide a pulsator assembly for a washing machine capable of increasing a washing efficiency by causing a vortex water current and preventing laundry articles from being tangled and twisted.

To achieve the above object, a pulsator assembly for a washing machine according to the present invention comprises a shaft pulley, a shaft, a connecting member, a confining part, an engaging part and a pulsator. The shaft pulley is connected to a driving pulley of a driving motor by means of a pulley belt. Accordingly, driving force for a forward or reverse rotation which is generated when the driving motor is rotated forwards or in reverse is transmitted to the shaft pulley through the pulley belt. One end of the shaft is fixed to the shaft pulley. The shaft rotates forwards or in reverse depending on the forward or reverse driving force transmitted to the shaft pulley. The other end of the shaft is engaged with the lower end of the connecting member. At the upper center of the connecting member, an inserting hole is formed due to engagement with the shaft. Along the outer periphery of the connecting member a plurality of fixed projecting portions are formed with a certain distance therebetween. The connecting member rotates forwards or in reverse according to the forward or reverse rotation of the shaft. A plurality of fixed projecting portions are engaged with the pulsator. The pulsator includes a plurality of grooves on the lower surface of the pulsator to receive the projecting portions of the connecting member as well as has a protuberance portion at the center of the lower surface thereof, and a sphere-shaped ball portion is provided at the end of the protuberance portion. The pulsator rocks in right, left, up and down directions while rotating forwards or in reverse according to the forward or reverse rotation of the connecting member. The plurality of fixed projecting portions of the connecting member are inserted into the plurality of grooves of the pulsator in a one to one manner and the ball portion of the pulsator is inserted into the inserting hole of the connecting member. The size of a groove is larger than that of a fixed projecting portion so that the pulsator can freely move without being fixed by the fixed projecting portions. The diameter of the inserting hole is larger than that of the ball portion in order for the ball portion to be freely rotated inside the inserting hole. Also, the pulsator assembly according to the present invention includes the confining part. The confining part is provided between the pulsator and the connecting member in order for the ball portion of the pulsator not to separate from the inserting hole of the connecting member. The engaging part fixes the confining part to the connecting member.

At a washing step, the rotation of the pulsator causes water and laundry article contained in a washing tub to be agitated. By this agitation of the water and laundry articles, the pulsator becomes loaded. At this time, as a load on the pulsator varies due to a change of a rotating speed or direction of the pulsator as well as due to the laundry article striking with the pulsator, the pulsator moves in right, left, up and down directions while rotating. This, as stated in the foregoing, is possible because the grooves of the pulsator and the fixed projecting portions of the connecting member are freely engaged with each other and the ball portion of the pulsator is inserted into the inserting hole of the connecting member so as to be freely rotatable by means of the confining part. Such irregular movements of the pulsator prevents the pulsator from being damaged by an overload to the pulsator due to the weight of laundry articles. Additionally, the rocking of the pulsator generates a vortex current of laundry water, and accordingly, the washing efficiency is increased and the tangling among the laundry articles is reduced.

BRIEF DESCRIPTION OF THE DRAWINGS

The above object and other features of the present invention will become apparent by describing a preferred embodiment of the present invention with reference to the accompanying drawings in which.

DETAILED DESCRIPTION OF THE PREFERRED EMBODIMENT

Hereinafter, a pulsator assembly for a washing machine according to a preferred embodiment of the present invention is described referring to the attached drawings.

Figures 1, 1A:
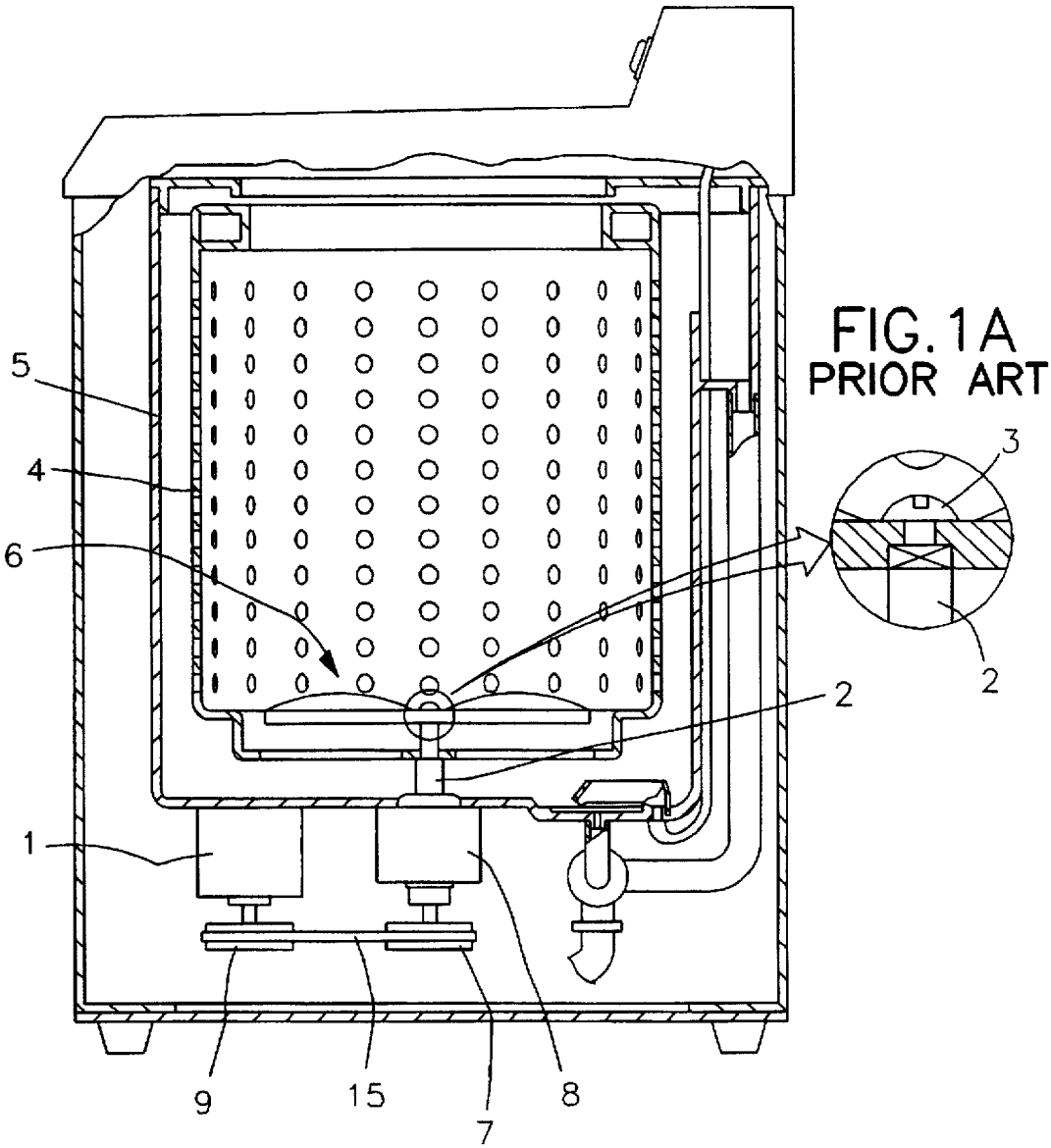
FIG. 1 PRIOR ART
FIG. 1A PRIOR ART
FIG. 1 is a brief schematic sectional view of a washing machine for showing a pulsator assembly installed in a conventional washing machine.
FIG. 1A is a sectional extending view for showing the engagement state of the shaft and pulsator depicted in FIG. 1.
Figure 2:
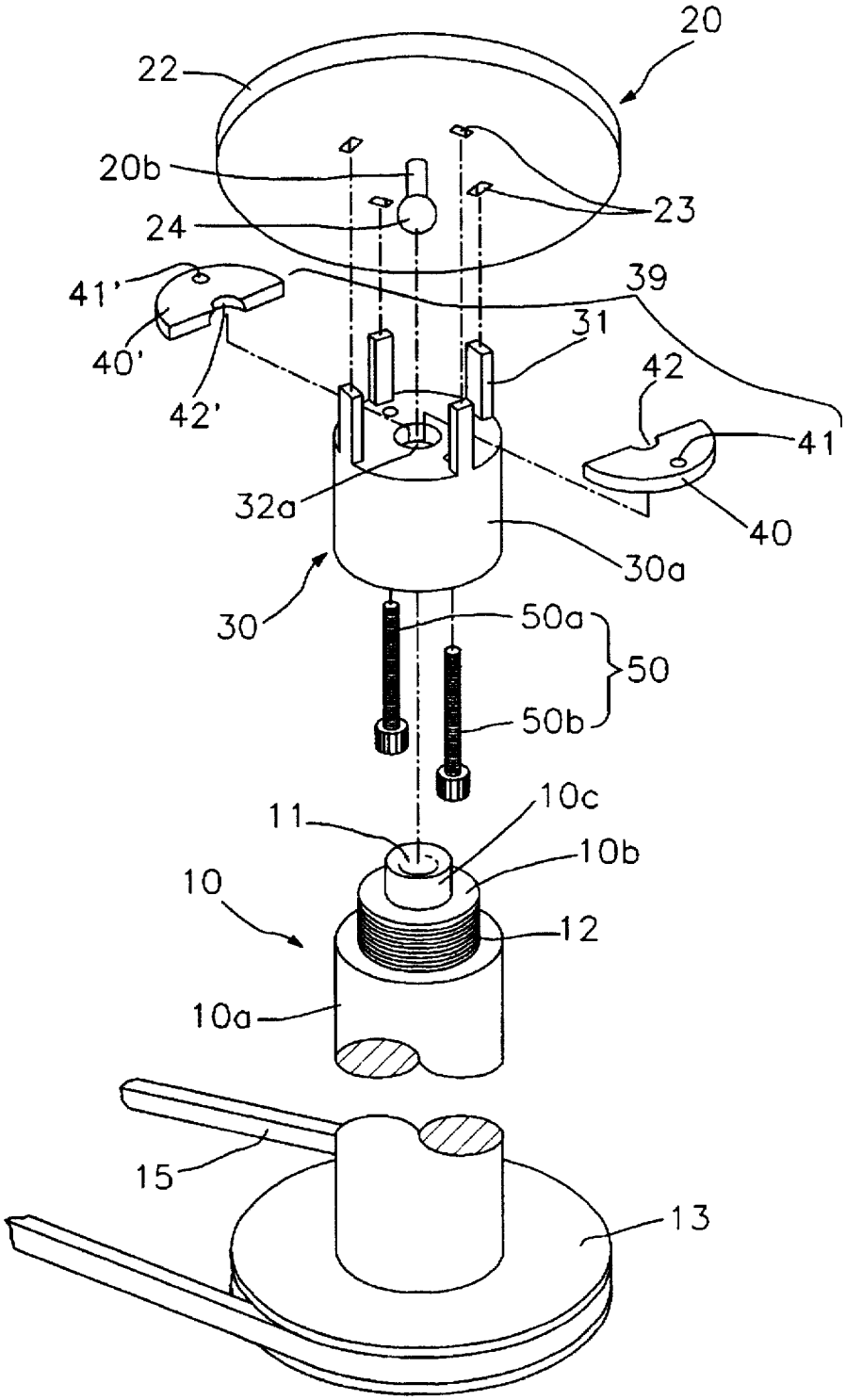
FIG. 2 is an exploded perspective view of a pulsator assembly for a washing machine according to an embodiment of the present invention.
Figure 3:
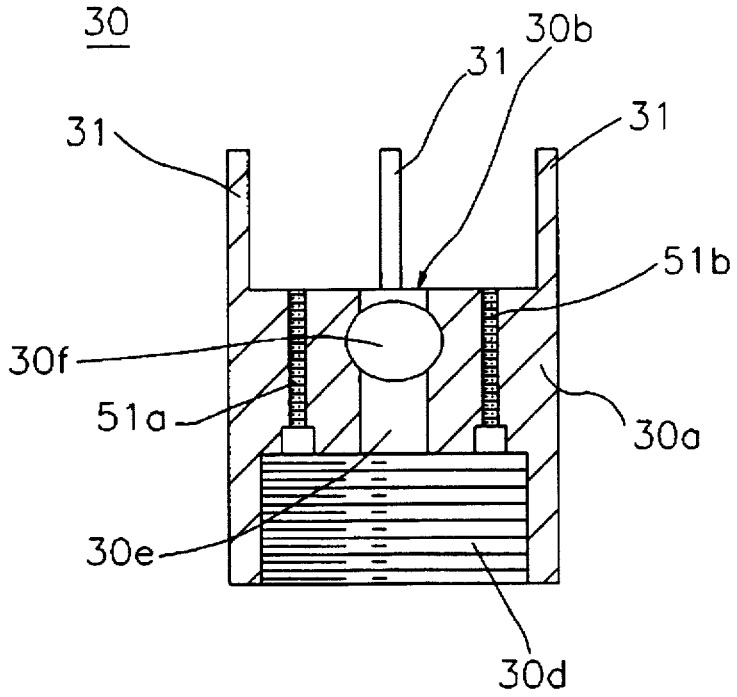
FIG. 3 is a sectional view of a connecting member shown in FIG. 2.
Figure 4:
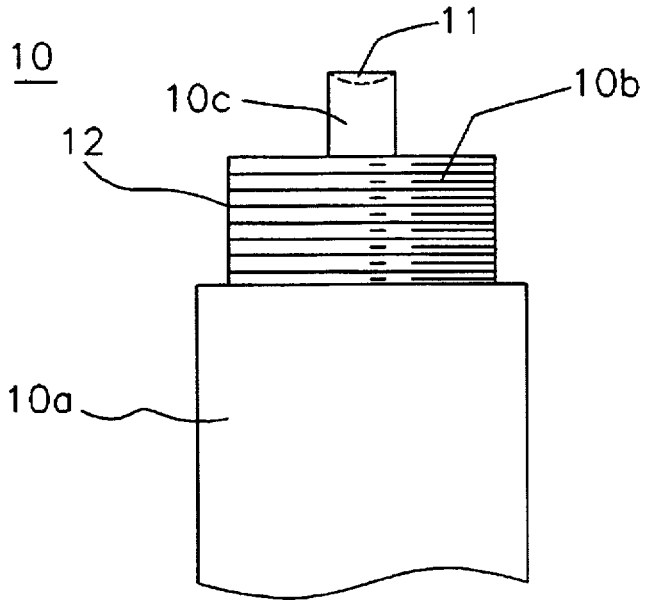
FIG. 4 is a sectional view of a shaft shown in FIG. 2.
Figure 5:
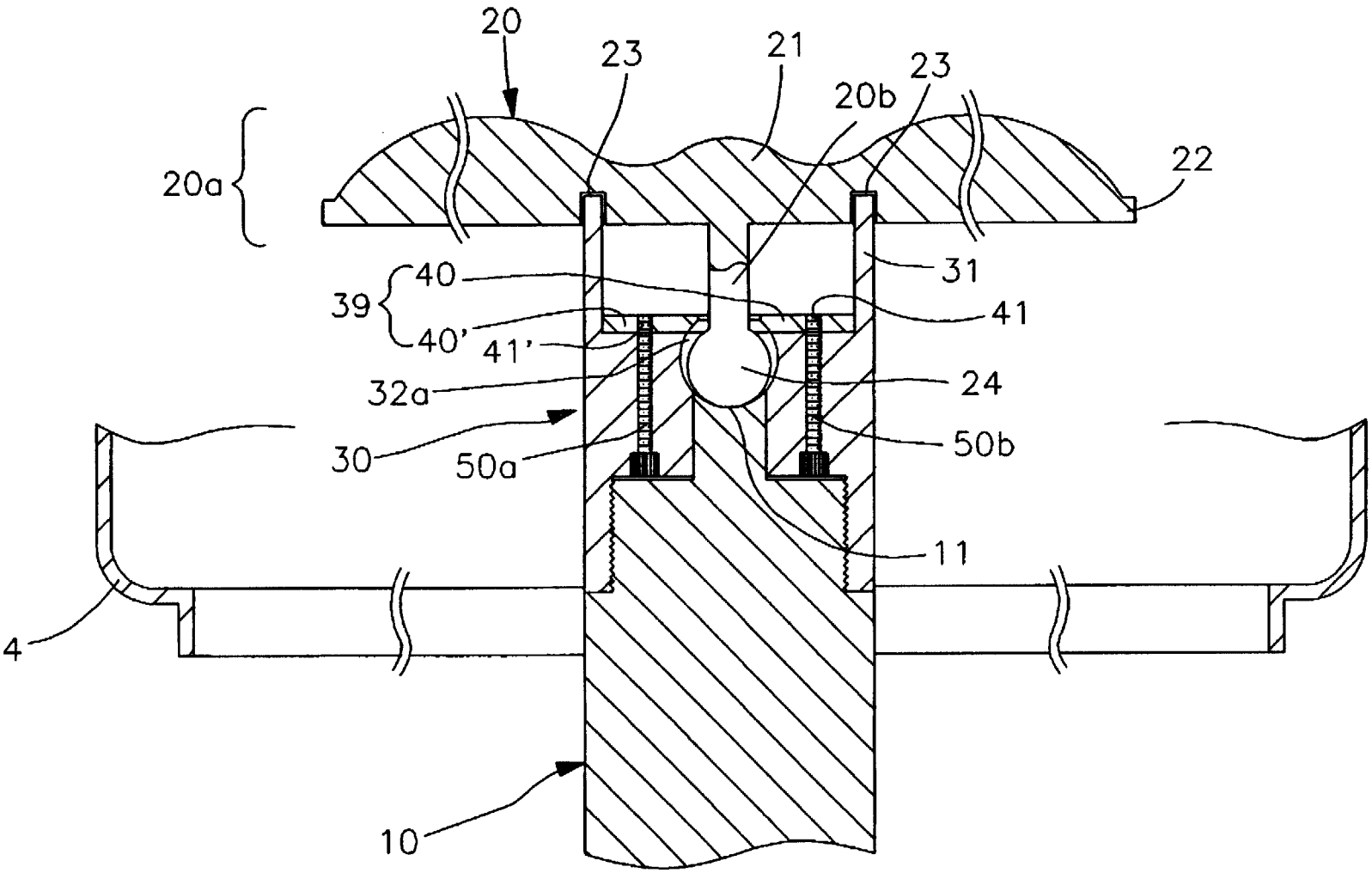
FIG. 5 is a sectional view of the pulsator assembly for a washing machine shown in FIG. 2.

FIG. 1 is a brief schematic sectional view of a washing machine for showing a pulsator assembly installed in a conventional washing machine, and FIG. 2 is an exploded perspective view of a pulsator assembly according to an embodiment of the present invention. In describing the pulsator assembly according to the embodiment of the present invention, reference numerals as shown in FIG. 1 are used for indicating general constitutional members of a washing machine. As shown in the drawings, a pulsator assembly for a washing machine according to the embodiment of the present invention comprises a shaft pulley 13, a shaft 10, a connecting member 30, a confining part 39, a engaging part 50 and a pulsator 20. Shaft pulley 13 is connected to a driving pulley 9 of a driving motor 1 by means of a pulley belt 15. Accordingly, driving force for a forward or reverse rotation which is generated when driving motor 1 is rotated forwards or in reverse is transmitted to shaft pulley 13 through pulley belt 15. One end of shaft 10 is fixed to shaft pulley 13. Shaft 10 rotates forwards or in reverse depending on the forward or reverse driving force transmitted to shaft pulley 13. The other end of shaft 10 is engaged with the lower end of connecting member 30. At the upper center of connecting member 30, an inserting hole 32*a* is formed due to engagement with shaft 10. Along the outer periphery of connecting member 30 a plurality of fixed projecting portions, for example, four fixed projecting portions 31 are provided at a certain distance therebetween. Connecting member 30 rotates forwards or in reverse according to the forward or reverse rotation of shaft 10. A plurality of fixed projecting portions are engaged with pulsator 20. The upper portion of connecting member 30 is engaged with pulsator 20. Pulsator 20 includes a plurality of grooves, for example, four grooves 23, on the lower surface of pulsator 20, a protuberance portion 20*b* is formed on the center of the lower surface thereof, and a sphere-shaped ball portion 24 is formed on the lower end of protuberance portion 20*b*. Pulsator 20 rocks in right, left, up and down directions while rotating forwards or in reverse according to the forward or reverse rotation of connecting member 30. A plurality of fixed projecting portions 31 of connecting member 30 are inserted into a plurality of grooves 23 of pulsator 20 in a one to one manner and ball portion 24 of pulsator 20 is inserted into inserting hole 32*a* of connecting member 30. The size of a groove 23 is larger than that of fixed projecting portion 31 so that pulsator 20 can freely move without being fixed to fixed projecting portion 31. The diameter of inserting hole 32*a* is larger than that of ball portion 24 in order for ball portion 24 to be freely rotated inside inserting hole 32*a*. Further, the pulsator assembly according to the embodiment of the present invention includes confining part 39. Confining part 39 is provided between pulsator 20 and connecting member 30 in order for ball portion 24 of pulsator 20 not to separate from inserting hole 32*a* of connecting member 30. Engaging part 50 fixes confining part 39 at connecting member 30. FIG. 4 is a sectional view of the shaft of FIG. 2. As shown in FIGS. 2 and 4, shaft 10 includes a shaft body portion 10*a*, a first cylinder portion 10*b* and a second cylinder portion 10*c*. Shaft body portion 10*a* is cylinder-shaped and one end thereof is fixed to shaft pulley 13. On the other end of shaft body portion 10*a*, first cylinder portion 10*b* is formed. First cylinder portion 10*b* is in the shape of a cylinder with a little smaller diameter than that of shaft body portion 10*a*. On the outer periphery surface of first cylinder portion 10*b* a screw thread 12 is formed. On first cylinder portion 10*b* second cylinder portion 10*c* is placed. Second cylinder portion 10*c* is also formed in a cylinder with smaller diameter than that of first cylinder portion 10*b*. On the upper surface of second cylinder portion 10*c*, an arc-shaped recess 11 is formed. FIG. 3 is a sectional view of the connecting member of FIG. 2. As shown in FIGS. 2 and 3, connecting member 30 includes a connecting member body portion 30*a* and fixed projecting portion 31. Connecting member body portion 30*a* has the same size of diameter as that of shaft 10, and a through hole 30*b* is formed at the center of connecting member body portion 30*a*. On the upper end of connecting member body portion 30*a*, a plurality of fixed projecting portions 31 are provided along the outer periphery of connecting member body portion 30*a* with a certain distance therebetween. Through hole 30*b* has a female screw portion 30*d*, a ball-receiving hole portion 30*f* and a communicating hole portion 30*e*. A screw thread is formed along the inner periphery surface of female screw portion 30*d*. The diameter of female screw portion 30*d* is the same as that of first cylinder portion 10*b*. Ball-receiving hole portion 30*f* has a ball-shaped space portion for receiving the ball portion. Communicating hole portion 30*e* allows female screw portion 30*d* and ball-receiving hole portion 30*f* to be communicated. The diameter of communicating hole portion 30*e* is the same as that of second cylinder portion 10*c*. Also, connecting member body portion 30*a* further includes a first engaging hole 51*a* and a second engaging hole 51*b*. First and second engaging holes 51*a* and 51*b* are disposed respectively in parallel with communicating hole portion 30*e* and pass through from female screw portion 30*d* to the upper end of connecting member 30 respectively. On each of the inner periphery surfaces of first and second engaging holes 51*a* and 51*b*, a screw thread is formed. FIG. 5 is a sectional view of the pulsator assembly for a washing machine of FIG. 2. As shown in FIGS. 2 and 5, pulsator 20 includes a disc-shaped pulsator body portion 20*a*, a protuberance portion 20*b* and a ball portion 24. Pulsator body portion 20*a* includes a round base plate 22 and a wing piece 21 of a predetermined shape. Wing piece 21 is disposed on round base plate 22. On the lower surface of round base plate 22 a plurality of grooves 23 are formed with a certain distance therebetween. On the center of the lower surface of round base plate 22, protuberance portion 20*b* is formed. On the lower end of protuberance portion 20*b* sphere-shaped ball portion 24 is formed. The predetermined shape of wing piece 21 may be a wave form and the wing piece is integrally formed with round base plate 22. Confining part 39 includes a first confining piece 40 and a second confining piece 40'. First confining piece 40 has a first engaging hole 41 and a first confining recess 42 and second confining piece 40' has a second engaging hole 41' and a second confining recess 42' First confining piece 40 and second confining piece 40' are respectively disposed inside a plurality of fixed projecting portions 31. First confining recess 42 of first confining piece 40 and second confining recess 42' of second confining piece 40' are opposedly disposed to form a confining hole. The confining hole receives projecting portion 20*b* of pulsator 20 and prevents pulsator 20 from separating from connecting member 30. Each of first confining piece 40 and second confining piece 40' has the shape of a semicircle. Engagement part 50 includes a first bolt 50*a* and a second bolt 50*b*. First bolt 50*a* and second bolt 50*b* pass through first engaging through hole 51*a* and second engaging through hole 51*b* respectively and are engaged with first engaging hole 41 and second engaging hole 41' of first confining piece 40 and second confining piece 40' respectively. By doing so, first confining piece 40 and second confining piece 40' are fixed to connecting member 30.

In the pulsator assembly for a washing machine according to the embodiment of the present invention as shown in FIG. 1, pulsator 20 is rotatably installed at the inner bottom of washing tub 4 placed within water reservoir 5. Connecting member 30 engaged with pulsator 20 and shaft 10 is installed outside water reservoir 5, passing through the center portions of water reservoir 5 and washing tub 4. Shaft 10 can be installed by shaft housing 8 to be rotated, and shaft housing 8 is situated at the center of the outer bottom of water reservoir 5. Shaft pulley 13 engaged with one end of shaft 10 is connected to driving pulley 9 of driving motor 1 by means of pulley belt 15.

The pulsator assembly for a washing machine with such a construction as above according to the embodiment of the present invention operates in the following manner.

Water is supplied into water reservoir 5 of a washing machine. Washing tub 4 is provided in water reservoir 5. A laundry article is put into washing tub 4. When driving motor 1 works at the washing step, a rotating force of driving motor 1 is transmitted to shaft pulley 13 by way of pulley belt 15 and driving pulley 9 to thereby rotate shaft pulley 13. Shaft pulley 13 rotates in a forward or reverse direction according to the rotating direction of driving motor 1. The rotation of shaft pulley 13 causes shaft 10, connecting member 30 and pulsator 20 to be rotated. The rotation of pulsator 20 agitates the water and laundry articles. By this agitating of the water and laundry articles, pulsator 20 becomes loaded. At this time, as the load carried by pulsator 20 varies due to a change of a rotating speed or direction of pulsator 20 or due to the laundry article striking with pulsator 20, pulsator 20 moves in right, left, up and down directions while rotating. This, as stated in the foregoing, is possible because grooves 23 of pulsator 20 and fixed projecting portions 31 of connecting member 30 are movably engaged with each other and ball portion 24 of pulsator 20 is rotatably engaged with inserting hole 32*a* of connecting member 30 by means of confining part 39. Such irregular movements of pulsator 20 prevent pulsator 20 from being overloaded due to the weight of laundry articles. Additionally, the rocking of pulsator 20 generates a vortex water current of laundry water, and accordingly, a washing efficiency is increased and tangling of the laundry articles is reduced.

Although the pulsator assembly for a washing machine has been described through a preferred embodiment of the present invention, variations and changes may be made without departing from the scope and the spirit of the invention.

What is claimed is:

1. A pulsator assembly for a washing machine comprising:

a driving means having a driving motor, a driving pulley, and a pulley belt, for generating a forward or reverse driving force, wherein the driving pulley is fixed to a rotating shaft of the driving motor and is connected with the pulley belt in order to drive the pulley belt according to a rotation force which is generated by the driving motor, thereby generating the forward or reverse driving force;

a shaft pulley connected with the driving pulley by the pulley belt, and for receiving the forward or reverse driving force which is transmitted by the pulley belt;

a shaft fixed to the shaft pulley so as to be rotated in a forward or reverse direction according to the forward or reverse driving force transmitted to the shaft pulley;

a connecting member having an inserting hole and a plurality of fixed projecting portions for rotating in a forward or reverse direction according to a forward or reverse rotation of the shaft, the inserting hole being formed at a central portion of an upper end of the connecting member, the plurality of fixed projecting portions being formed in a certain distance therebetween along an outer periphery of the upper end of the connecting member;

a pulsator having a plurality of grooves formed on a lower surface of the pulsator, a protuberance portion formed at a central portion of the lower surface, and a sphere-shaped ball portion formed on a lower end of the protuberance portion, wherein the pulsator rocks in right, left, up and down directions while rotating forwards or in reverse according to a forward or reverse rotation of the connecting member, the plurality of fixed projecting portions of the connecting member are inserted in the plurality of grooves one to one, the sphere-shaped ball portion is inserted into the inserting hole of the connecting member, a size of each of the plurality of grooves is larger than that of each of the plurality of fixed projecting portions in order for the pulsator to freely move without being fixed by the fixed projecting portions, and a diameter of the inserting hole is larger than that of the ball portion in order for the sphere shaped ball portion to freely move inside the inserting hole;

a confining part disposed between the pulsator and the connecting member in order for the sphere-shaped ball portion to be prevented from separating from the inserting hole of the connecting member; and an engagement part for fixing the confining part to the connecting member.

2. The pulsator assembly as claimed in claim 1, wherein the shaft includes:

a shaft body portion formed in a shape of a cylinder, and one end thereof being engaged with the shaft pulley;

a first cylinder portion formed in a shape of a cylinder on the other end of the shaft body portion, the first cylinder portion having a smaller diameter than that of the shaft body portion, and a screw thread being formed on the outer periphery surface of the first cylinder portion; and a second cylinder portion formed in a shape of a cylinder on an upper surface of the first cylinder portion, the second cylinder portion having a smaller diameter than that of the first cylinder portion, and an arc-shaped recess being formed on the upper end surface of the first cylinder portion.

3. The pulsator assembly as claimed in claim 2, wherein the connecting member includes a connecting member body portion with the same diameter as that of the shaft, a through hole being formed at the center thereof, and a plurality of fixed projecting portions being formed along the outer periphery of the upper end of the connecting member body portion.

4. The pulsator assembly as claimed in claim 3, wherein the connecting member body portion includes a first engaging hole and a second engaging hole;

the through hole includes:

a female screw portion formed along an inner periphery surface thereof, a diameter thereof being the same as that of the first cylinder portion, a ball-receiving hole portion formed in a sphere-shaped space, and a communicating hole portion for allowing the female screw portion and the ball-receiving hole portion to be communicated, a diameter thereof being the same as that of the second cylinder portion; and the plurality of engaging holes formed respectively in parallel with the communicating hole portion and passing through from the female screw portion to the upper end of the connecting member.

5. The pulsator assembly as claimed in claim 4, wherein on the inner periphery surfaces of the first engaging hole and the second engaging hole screw threads are formed.

6. The pulsator assembly as claimed in claim 1, wherein the pulsator includes:

a pulsator body portion having a wing piece in a predetermined shape and a round base plate in a predetermined thickness, the wing piece being disposed on the upper surface thereof, and the plurality of grooves being formed on the lower surface thereof in a certain distance;

the protuberance portion protruding from the center of the lower surface of the round base plate of the pulsator body; and the ball portion formed in a shape of a sphere on one end of the protuberance portion.

7. The pulsator assembly as claimed in claim 6, wherein the predetermined shape of the wing piece is a wave form and the wing piece is integrally formed with the round base plate.

8. The pulsator assembly as claimed in claim 1, wherein the confining part includes a first confining piece and a second confining piece, the first confining piece having a first engaging hole and a first confining recess, and the second confining piece having a second engaging hole and a second confining recess, the first confining piece and the second confining piece are respectively disposed inside the plurality of fixed projecting portions, the first confining recess of the first confining piece and the second confining recess of the second confining piece are opposedly disposed to form a confining hole, and the confining hole receives the protuberance portion of the pulsator to prevent the connecting member from separating from the pulsator.

9. The pulsator assembly as claimed in claim 8, wherein each of the first confining piece and the second confining piece has a shape of a semicircle.

10. The pulsator assembly as claimed in claim 8, wherein the engagement part includes a first bolt and a second bolt, and the first bolt and the second bolt pass through from the first engaging hole and the second engaging hole to the first engaging hole and the second engaging hole of the first confining piece and the second confining piece respectively in order for the first confining piece and the second confining piece to be fixed to the connecting member.

* * * * *